US008763719B2

(12) United States Patent
White

(10) Patent No.: US 8,763,719 B2
(45) Date of Patent: Jul. 1, 2014

(54) PILE DRIVING SYSTEMS AND METHODS EMPLOYING PRELOADED DROP HAMMER

(75) Inventor: John L. White, Kent, WA (US)

(73) Assignee: American Piledriving Equipment, Inc., Kent, WA (US)

( * ) Notice: Subject to any disclaimer, the term of this patent is extended or adjusted under 35 U.S.C. 154(b) by 226 days.

(21) Appl. No.: 12/683,383

(22) Filed: Jan. 6, 2010

(65) Prior Publication Data

US 2011/0162859 A1 Jul. 7, 2011

(51) Int. Cl.
*E02D 7/14* (2006.01)
*E02D 7/06* (2006.01)
*E02D 7/12* (2006.01)

(52) U.S. Cl.
CPC ..... *E02D 7/125* (2013.01)
USPC ..... 173/1; 173/89; 173/132; 173/200; 173/204; 173/206; 173/212; 173/138; 91/417 R; 91/408

(58) Field of Classification Search
USPC ..... 173/1, 89, 132, 200, 204, 206, 212, 173/138; 91/417 R, 408; 405/228
See application file for complete search history.

(56) References Cited

U.S. PATENT DOCUMENTS

| | | | |
|---|---|---|---|
| 5,015 | A | 3/1847 | Ingalls |
| 48,515 | A | 7/1865 | Campbell et al. |
| 369,176 | A | 8/1887 | Gerstein |
| 400,209 | A | 3/1889 | Haskins |
| 628,962 | A | 7/1899 | Speer |
| 999,334 | A | 8/1911 | Pearson |
| 1,128,808 | A | 2/1915 | Manoogian |
| 1,213,800 | A | 1/1917 | Piper |
| 1,288,989 | A | 12/1918 | Rees |
| 1,294,154 | A | 2/1919 | Payne |
| 1,322,470 | A | 11/1919 | Schenk |
| 1,348,994 | A | 8/1920 | Heckle |

(Continued)

FOREIGN PATENT DOCUMENTS

| | | |
|---|---|---|
| DE | 4010357 | 10/1990 |
| DE | 102006053482 | 6/2008 |

(Continued)

OTHER PUBLICATIONS

American Piledriving Equipment, Inc., A series of photographs identified by Reference Nos. APE01147-APE01159, undated, 13 pages.

(Continued)

*Primary Examiner* — Michelle Lopez
(74) *Attorney, Agent, or Firm* — Michael R. Schacht; Schacht Law Office, Inc.

(57) ABSTRACT

A pile driving system for driving a pile. The pile driving system comprises a housing assembly, a hammer, a helmet member, and a lifting system. The housing assembly defines at least one vent opening is arranged at a first vent location along the drive axis, and at least one vent opening is arranged at a second vent location along the drive axis. When the hammer drops and is above the first vent location, ambient air flows from the main chamber through the vent openings formed at the first and second vent locations. When the hammer is below the first vent location and above the second vent location, ambient air flows from the main chamber through the vent openings formed at the second vent location. When the hammer is below the second vent location, air within the main chamber is compressed to preload the helmet member.

17 Claims, 7 Drawing Sheets

(56) References Cited

U.S. PATENT DOCUMENTS 1,464,231 A 8/1923 Yezek
1,654,093 A 12/1927 Reid
1,702,349 A 2/1929 Krell
1,748,555 A 2/1930 Kinney
1,762,037 A 6/1930 Taylor
1,769,169 A 7/1930 Thornley
1,787,000 A 12/1930 Hunt
1,903,555 A 4/1933 Robertson
1,914,899 A 6/1933 Syme
1,988,173 A 1/1935 Kersting
2,068,045 A 1/1937 Wohlmeyer
2,239,024 A 4/1941 Vance
2,577,252 A 12/1951 Kjellman
2,723,532 A 11/1955 Smith
2,755,783 A 7/1956 Kupka
2,842,972 A 7/1958 Houdart
2,859,628 A 11/1958 Arko
2,904,964 A 9/1959 Kupka
2,952,132 A 9/1960 Urban
3,001,515 A 9/1961 Haage
3,004,389 A 10/1961 Muller
3,034,304 A 5/1962 Upson
3,094,007 A 6/1963 Luhrs
3,100,382 A 8/1963 Muller
3,101,552 A 8/1963 Tandler
3,106,258 A 10/1963 Muller
3,115,198 A 12/1963 Kuss
3,149,851 A 9/1964 Adams
3,172,485 A 3/1965 Spannhake et al.
3,177,029 A 4/1965 Larson
3,193,026 A 7/1965 Kupka
3,227,483 A 1/1966 Guild et al.
3,243,190 A 3/1966 Peregrine
3,267,677 A 8/1966 Bollar
3,289,774 A 12/1966 Bodine, Jr.
3,300,987 A 1/1967 Maeda
3,313,376 A 4/1967 Holland, Sr.
3,371,727 A 3/1968 Belousov et al.
3,381,422 A 5/1968 Olson
3,391,435 A 7/1968 Lebelle
3,394,766 A 7/1968 Lebelle
3,412,813 A 11/1968 Johnson
3,447,423 A 6/1969 Henry
3,450,398 A 6/1969 Barnes
3,460,637 A 8/1969 Schulin
3,513,587 A 5/1970 Fischer
3,530,947 A 9/1970 Gendron et al.
3,577,645 A 5/1971 Zurawski
3,583,497 A 6/1971 Kossowski et al.
3,616,453 A 10/1971 Philpot
3,620,137 A 11/1971 Prasse
3,638,738 A 2/1972 Varnell
3,679,005 A 7/1972 Inaba et al.
3,684,037 A 8/1972 Bodine
3,686,877 A 8/1972 Bodin
3,711,161 A 1/1973 Proctor et al.
3,720,435 A 3/1973 Leyn
3,734,209 A 5/1973 Haisch et al.
3,786,874 A 1/1974 Jodet et al.
3,789,930 A 2/1974 Nishimura et al.
3,797,585 A 3/1974 Ludvigson
3,822,969 A 7/1974 Kummel
3,828,864 A 8/1974 Haverkamp et al.
3,854,418 A 12/1974 Bertin
3,861,664 A 1/1975 Durkee
3,865,501 A 2/1975 Kniep
3,871,617 A 3/1975 Majima
3,874,244 A 4/1975 Rasmussen et al.
3,891,186 A 6/1975 Thorsell
3,907,042 A 9/1975 Halwas et al.
3,952,796 A 4/1976 Larson
3,959,557 A 5/1976 Berry
3,967,688 A 7/1976 Inenaga et al.
3,975,918 A 8/1976 Jansz
3,991,833 A 11/1976 Ruppert
3,998,063 A 12/1976 Harders
4,018,290 A 4/1977 Schmidt
4,029,158 A 6/1977 Gerrish
4,033,419 A 7/1977 Pennington
4,067,369 A 1/1978 Harmon
4,076,081 A 2/1978 Schnell
4,082,361 A 4/1978 Lanfermann
4,099,387 A 7/1978 Frederick et al.
4,100,974 A 7/1978 Pepe
4,102,408 A 7/1978 Ludvigson
4,109,475 A 8/1978 Schnell
4,113,034 A 9/1978 Carlson
4,119,159 A 10/1978 Arentsen
4,143,985 A 3/1979 Axelsson et al.
4,154,307 A 5/1979 Gendron et al.
4,155,600 A 5/1979 Lanfermann et al.
4,166,508 A 9/1979 van den Berg
4,180,047 A 12/1979 Bertelson
4,187,917 A * 2/1980 Bouyoucos ..... 173/131
4,195,698 A 4/1980 Nakagawasai
4,248,550 A 2/1981 Blaschke et al.
4,262,755 A 4/1981 Kuhn
4,274,761 A 6/1981 Boguth
4,312,413 A 1/1982 Loftis
4,362,216 A 12/1982 Jansz
4,366,870 A 1/1983 Frederick
4,367,800 A 1/1983 Arentsen
4,375,927 A 3/1983 Kniep
4,380,918 A 4/1983 Killop
4,397,199 A 8/1983 Jahn
4,421,180 A 12/1983 Fleishman et al.
4,428,699 A 1/1984 Juhola
4,430,024 A 2/1984 Guild et al.
4,436,452 A 3/1984 Bodine
4,455,105 A 6/1984 Juhola
4,465,145 A 8/1984 Kuhn
4,497,376 A 2/1985 Kurylko
4,505,614 A 3/1985 Anschutz
4,519,729 A 5/1985 Clarke, Jr. et al.
4,537,527 A 8/1985 Juhola et al.
4,547,110 A 10/1985 Davidson
4,553,443 A 11/1985 Rossfelder et al.
4,601,615 A 7/1986 Cavalli
4,603,748 A 8/1986 Rossfelder et al.
4,624,325 A 11/1986 Steiner
4,626,138 A 12/1986 Boyes
4,627,768 A 12/1986 Thomas et al.
4,632,602 A 12/1986 Hovnanian
4,637,475 A 1/1987 England et al.
4,645,017 A 2/1987 Bodine
4,687,026 A 8/1987 Westman
4,725,167 A 2/1988 Merjan
4,735,270 A 4/1988 Fenyvesi
4,755,080 A 7/1988 Cortlever et al.
4,757,809 A 7/1988 Koeneman et al.
4,758,148 A 7/1988 Jidell
4,768,900 A 9/1988 Burland
4,799,557 A 1/1989 Jacquemet
4,813,814 A 3/1989 Shibuta et al.
4,844,661 A 7/1989 Martin et al.
4,863,312 A 9/1989 Cavalli
4,915,180 A 4/1990 Schisler
4,961,471 A 10/1990 Ovens
4,974,997 A 12/1990 Sero et al.
4,989,677 A 2/1991 Lam
4,993,500 A 2/1991 Greene et al.
5,004,055 A 4/1991 Porritt et al.
5,018,251 A 5/1991 Brown
5,076,090 A 12/1991 Cetnarowski
5,088,565 A 2/1992 Evarts
5,107,934 A 4/1992 Atchison
5,117,925 A 6/1992 White
5,154,667 A 10/1992 Mauch et al.
5,161,625 A 11/1992 Seng
5,213,449 A 5/1993 Morris
5,253,542 A 10/1993 Houze
RE34,460 E 11/1993 Ishiguro et al.
5,263,544 A 11/1993 White
5,281,775 A 1/1994 Gremillion

(56) References Cited

U.S. PATENT DOCUMENTS

| | | | | |
|---|---|---|---|---|
| 5,343,002 | A | 8/1994 | Gremillion | |
| 5,355,964 | A | 10/1994 | White | |
| 5,375,897 | A | 12/1994 | Gazel-Anthoine | |
| 5,385,218 | A | 1/1995 | Migliori | |
| 5,409,070 | A | 4/1995 | Roussy | |
| 5,410,879 | A | 5/1995 | Houze | |
| 5,423,633 | A | 6/1995 | Verstraeten | |
| 5,439,326 | A | 8/1995 | Goughnour et al. | |
| 5,540,295 | A | 7/1996 | Serrette | |
| 5,544,979 | A | 8/1996 | White | |
| 5,549,168 | A | 8/1996 | Sadler et al. | |
| 5,551,804 | A | 9/1996 | Breaux et al. | |
| 5,562,169 | A | 10/1996 | Barrow | |
| 5,609,380 | A | 3/1997 | White | |
| 5,653,556 | A | 8/1997 | White | |
| 5,658,091 | A | 8/1997 | Goughnour et al. | |
| 5,727,639 | A | 3/1998 | Jeter | |
| 5,788,419 | A | 8/1998 | Whitty, Jr. et al. | |
| 5,794,716 | A | 8/1998 | White | |
| 5,811,741 | A | 9/1998 | Coast et al. | |
| 5,836,205 | A | 11/1998 | Meyer | |
| 5,860,482 | A | 1/1999 | Gremillion et al. | |
| 5,934,835 | A | 8/1999 | Whitty, Jr. et al. | |
| 6,003,619 | A | 12/1999 | Lange | |
| 6,039,508 | A | 3/2000 | White | |
| 6,056,070 | A | 5/2000 | Shinohara et al. | |
| 6,102,133 | A | 8/2000 | Scheid et al. | |
| 6,129,159 | A | 10/2000 | Scott et al. | |
| 6,129,487 | A | 10/2000 | Bermingham et al. | |
| 6,155,353 | A | 12/2000 | Ottestad | |
| 6,179,527 | B1 | 1/2001 | Goughnour | |
| 6,186,043 | B1 * | 2/2001 | Callies | 91/408 |
| 6,216,394 | B1 | 4/2001 | Fenelon | |
| 6,224,294 | B1 | 5/2001 | Mansfield | |
| 6,227,767 | B1 | 5/2001 | Mosing et al. | |
| 6,234,260 | B1 | 5/2001 | Coast et al. | |
| 6,250,426 | B1 | 6/2001 | Lombard | |
| 6,360,829 | B1 | 3/2002 | Naber et al. | |
| 6,364,577 | B1 | 4/2002 | Haney | |
| 6,386,295 | B1 | 5/2002 | Suver | |
| 6,427,402 | B1 | 8/2002 | White | |
| 6,431,795 | B2 | 8/2002 | White | |
| 6,447,036 | B1 | 9/2002 | White | |
| 6,484,553 | B1 | 11/2002 | Devers | |
| 6,543,966 | B2 | 4/2003 | White | |
| 6,557,647 | B2 | 5/2003 | White | |
| 6,582,158 | B1 | 6/2003 | Van Stein | |
| 6,648,556 | B1 | 11/2003 | White | |
| 6,652,194 | B2 | 11/2003 | Ingle | |
| 6,672,805 | B1 | 1/2004 | White | |
| 6,691,797 | B1 | 2/2004 | Hart | |
| 6,732,483 | B1 | 5/2004 | White | |
| 6,736,218 | B1 | 5/2004 | White | |
| 6,752,043 | B2 | 6/2004 | Carlson | |
| 6,860,338 | B2 | 3/2005 | Salesse et al. | |
| 6,896,448 | B1 | 5/2005 | White | |
| 6,908,262 | B1 | 6/2005 | White | |
| 6,942,430 | B1 | 9/2005 | Suver | |
| 6,988,564 | B2 | 1/2006 | White | |
| 7,043,806 | B2 | 5/2006 | Schrock et al. | |
| 7,168,890 | B1 | 1/2007 | Evarts | |
| 7,392,855 | B1 | 7/2008 | White | |
| 7,404,449 | B2 | 7/2008 | Bermingham et al. | |
| 7,407,343 | B2 | 8/2008 | van Halteren et al. | |
| 7,591,612 | B2 | 9/2009 | Wong | |
| 7,694,747 | B1 | 4/2010 | White | |
| 7,708,499 | B1 | 5/2010 | Evarts et al. | |
| 7,824,132 | B1 | 11/2010 | White | |
| 7,854,571 | B1 | 12/2010 | Evarts | |
| 7,950,877 | B2 | 5/2011 | Evarts | |
| 8,070,391 | B2 | 12/2011 | White | |
| 8,181,713 | B2 | 5/2012 | White | |
| 8,186,452 | B1 | 5/2012 | White et al. | |
| 2003/0143036 | A1 | 7/2003 | Larsen, Jr. | |
| 2005/0013675 | A1 | 1/2005 | Bengston et al. | |
| 2005/0232708 | A1 | 10/2005 | White | |
| 2006/0052818 | A1 | 3/2006 | Drake et al. | |
| 2006/0113456 | A1 | 6/2006 | Miller | |
| 2006/0216118 | A1 | 9/2006 | Wong | |
| 2008/0310923 | A1 | 12/2008 | Jinnings et al. | |
| 2009/0129870 | A1 | 5/2009 | Jones | |
| 2010/0303552 | A1 | 12/2010 | Yingling et al. | |
| 2011/0162859 | A1 | 7/2011 | White | |
| 2011/0243668 | A1 | 10/2011 | White | |
| 2011/0252610 | A1 | 10/2011 | Evarts | |
| 2012/0114424 | A1 | 5/2012 | White | |

FOREIGN PATENT DOCUMENTS

| | | |
|---|---|---|
| EP | 0172960 | 5/1986 |
| EP | 362158 | 4/1990 |
| EP | 526743 | 10/1993 |
| FR | 838717 | 3/1939 |
| FR | 2560247 | 8/1985 |
| GB | 1066727 | 4/1967 |
| GB | 2003769 | 3/1979 |
| GB | 2023496 | 1/1980 |
| GB | 2028902 | 3/1980 |
| GB | 2043755 | 10/1980 |
| GB | 2060742 | 5/1981 |
| JP | 355098526 | 7/1980 |
| JP | 356034828 | 4/1981 |
| JP | 57169130 | 10/1982 |
| JP | 59228529 | 12/1984 |
| JP | 61221416 | 10/1986 |
| JP | 0258627 | 2/1990 |
| JP | 497015 | 3/1992 |
| JP | 5246681 | 9/1993 |
| JP | 6136751 | 5/1994 |
| JP | 09328983 | 12/1997 |
| KR | 1020010044658 | 6/2001 |
| KR | 1020030017742 | 3/2003 |
| NL | 65252 | 2/1950 |
| NL | 7710385 | 3/1978 |
| SU | 1027357 | 7/1983 |
| WO | 8707673 | 12/1987 |
| WO | 8805843 | 8/1988 |

OTHER PUBLICATIONS

APE, "APE Model 8 Hydraulic Impact Hammer," undated, 1 page.
Japan Development Consultants, Inc., "Castle Board Drain Method" Japanese language brochure, Ref. Nos. APE00857-APE00863, Aug. 1976, 7 pages.
International Construction Equipment, Inc., "Diesel Pile Hammers" brochure, Ref. No. DH4-1288-5C, undated, 6 pages.
International Construction Equipment, Inc., "Hydraulic Vibratory Driver/Extractors for Piling and Caisson Work," undated, 10 pages.
International Construction Equipment, Inc., "Hydraulic Vibratory Driver/Extractors for Piling and Caisson Work," Ref. No. V7-0890-51, undated, 3 pages.
"Kony Drain Board," undated, 1 page.
www.mmsonline.com/columns/micro-keying-keeps-a-better-grip.aspx, Seibert, Stan, Modern Machine Shop: "Micro-Keying Keeps a Better Grip," Aug. 1, 1992, 2 pages.
MKT Geotechnical Systems, Manual No. 01807: "Operating, Maintenance and Parts manual for MS350 and MS500 Single-Acting Pile Hammers," undated, 12 pages.
Report identifying systems for driving mandrels carrying wick drain material into the earth, Ref. Nos. APE0510-APE0536, undated, 27 pages.
Schematic drawings, Ref. Nos. APE01038, APE01039, APE0339, undated, 3 pages.
Shanghai Jintai SEMW, undated, 8 pages.
International Searching Authority, "International Search Report", Jan. 28, 2011, 11 pages.

* cited by examiner

PILE DRIVING SYSTEMS AND METHODS EMPLOYING PRELOADED DROP HAMMER

TECHNICAL FIELD

The present invention relates to methods and apparatus for inserting elongate members into the earth and, more particularly, to drop hammers that create pile driving forces by lifting and dropping a hammer to apply a driving force to the top of a pile.

BACKGROUND OF THE INVENTION

For certain construction projects, elongate members such as piles, anchor members, caissons, and mandrels for inserting wick drain material must be placed into the earth. It is well-known that such rigid members may often be driven into the earth without prior excavation. The term "piles" will be used herein to refer to the elongate rigid members typically driven into the earth.

One system for driving piles is conventionally referred to as a diesel hammer. A diesel hammer employs a floating ram member that acts both as a ram for driving the pile and as a piston for compressing diesel fuel. Diesel fuel is injected into a combustion chamber below the ram member as the ram member drops. The dropping ram member engages a helmet member that transfers the load of the ram member to the pile to drive the pile. At the same time, the diesel fuel ignites, forcing the ram member and the helmet member in opposite directions. The helmet member further drives the pile, while the ram member begins a new combustion cycle. Another such system is a drop hammer that repeatedly lifts and drops a hammer onto an upper end of the pile to drive the pile into the earth.

Diesel hammers seem to exhibit fewer problems with tension cracking in concrete piles and pile driving helmets than similarly configured external combustion hammers. The Applicant has recognized that the combustion chambers of diesel hammers pre-load the system before the hammer impact and that this preloading may explain the reduction of tension cracking in concrete piles associated with diesel hammers.

The need thus exists for improved drop hammers that induce stresses in the pile driven that are similar to the stresses induced by diesel hammers.

SUMMARY OF THE INVENTION

The present invention may be embodied as a pile driving system for driving a pile comprising a housing assembly, a hammer, a helmet member, and a lifting system. The housing assembly defines a drive axis, a main chamber, and a plurality of vent openings that allow fluid to flow into and out of the main chamber. At least one vent opening is arranged at a first vent location along the drive axis, and at least one vent opening is arranged at a second vent location along the drive axis. The second vent location is spaced along the drive axis from the first vent location. The hammer supported within the main chamber for movement relative to the housing assembly between an upper position and a lower position. The first and second vent locations are located between the upper and lower positions. The helmet member is supported by the housing assembly for movement relative to the housing assembly between a first position and a second position. The lifting system displaces the hammer from the lower position to the upper position during each cycle. When the hammer drops and is above the first vent location, ambient air flows from the main chamber through the vent openings formed at the first and second vent locations. When the hammer drops and is below the first vent location and above the second vent location, ambient air flows from the main chamber through the vent openings formed at the second vent location. When the hammer drops and is below the second vent location, air within the main chamber is compressed to preload the helmet member prior to contact between the hammer and helmet member.

The present invention may also be embodied as a method of driving a pile comprising the following steps. A housing assembly defining a drive axis and a main chamber is provided. At least one vent opening is formed in the housing at a first vent location along the drive axis. At least one vent opening is formed at a second vent location along the drive axis. The second vent location is spaced along the drive axis from the first vent location. A hammer is supported at least partly within the main chamber for movement relative to the housing assembly between an upper position and a lower position; the first and second vent locations are located between the upper and lower positions. A helmet member is supported for movement relative to the housing assembly between a first position and a second position. The hammer is displaced from the lower position to the upper position during each cycle.

Ambient air is allowed to flow from the main chamber through the vent openings formed at the first and second vent locations when the hammer is moving down and is above the first vent location. Ambient air is allowed to flow from the main chamber through the vent openings formed at the second vent location when the hammer is moving down and is below the first vent location and above the second vent location. Air within the main chamber below the hammer is compressed to preload the helmet member prior to contact between the hammer and helmet member when the hammer is below the second vent location.

The present invention may also be embodied as a pile driving system for driving a pile comprising a housing assembly defining a drive axis, a main chamber, and a plurality of vent openings that allow fluid to flow into and out of the main chamber. At least one vent opening is arranged at a first vent location along the drive axis. At least one vent opening is arranged at a second vent location along the drive axis; the second vent location is spaced along the drive axis from the first vent location. At least one of a plurality of plugs is engaged with at least one of the vent openings to obtain a desired compression profile. A hammer is supported within the main chamber for movement relative to the housing assembly between an upper position and a lower position; the first and second vent locations are located between the upper and lower positions. A helmet member is supported by the housing assembly for movement relative to the housing assembly between a first position and a second position. The lifting system displaces the hammer from the lower position to the upper position during each cycle.

When the hammer drops and is above the first vent location, ambient air flows from the main chamber through the vent openings formed at the first and second vent locations according to the compression profile. When the hammer drops and is below the first vent location and above the second vent location, ambient air flows from the main chamber through the vent openings formed at the second vent location according to the compression profile. When the hammer drops and is below the second vent location, air within the main chamber is compressed to preload the helmet member prior to contact between the hammer and helmet member according to the compression profile.

DETAILED DESCRIPTION OF THE INVENTION

Figure 1:
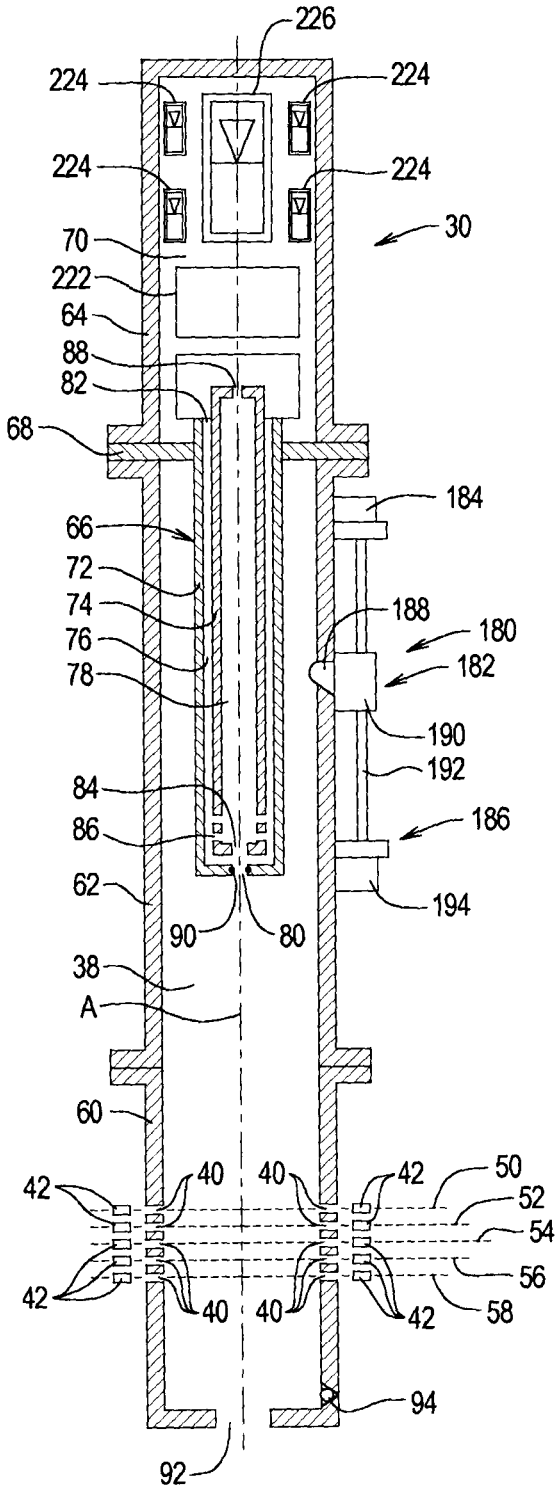
FIG. 1 is a somewhat schematic section view of an example housing assembly of a pile driving system of the present invention.

Turning initially to the drawing, depicted in FIGS. 5A-5H therein is a pile driving system 20 constructed in accordance with, and embodying, the principles of the present invention. As shown in FIGS. 5A-5H, the pile driving system 20 is configured to drive a pile 22. The example pile driving system 20 comprises a housing assembly 30 (FIG. 1), a hammer assembly 32 (FIG. 2), an anvil assembly 34 (FIG. 3), and a helmet assembly 36 (FIG. 4).

Figure 5A:
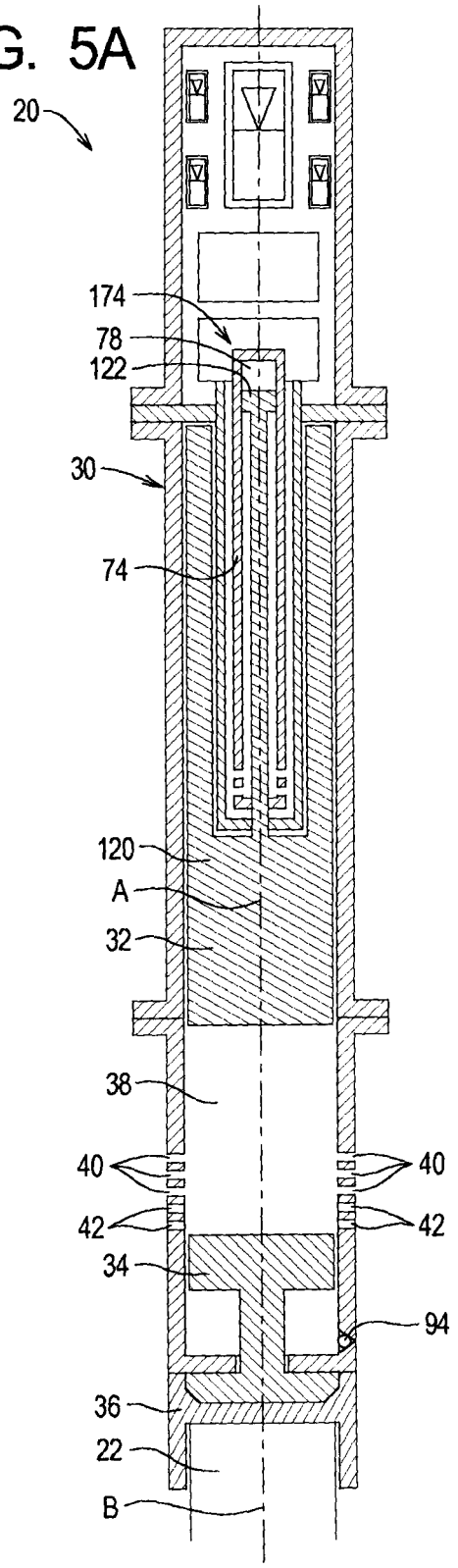
FIGS. 5A-5H are somewhat schematic views of an example pile driving system of the present invention illustrating an example operation cycle.

FIG. 5A illustrates that the pile driving system 20 defines a drive axis A (also shown in FIG. 1) and that the drive axis A is aligned with a pile axis B defined by the pile 22. FIG. 1 illustrates that the housing assembly 30 defines a main chamber 38, while FIG. 5A further illustrates that housing assembly 30 supports the hammer assembly 32 within the main chamber 38. The anvil assembly 34 is partly disposed within the main chamber 38 and is thus supported by the housing assembly 30. The helmet assembly 36 is placed on top of the pile 22 and is adapted to engage the anvil assembly 34. The hammer assembly 32, anvil assembly 34, helmet assembly 36, and pile 22 all are capable of moving relative to the housing assembly 30 along the drive axis A.

As perhaps best shown in FIG. 1, at least one vent opening 40 is arranged in a plurality (two or more) of spaced vent locations along the drive axis A. FIG. 1 also shows that the housing assembly 30 further comprises a plurality of vent plugs 42 that may be used to close any of the vent openings 40. The example vent openings 40 are threaded holes formed in the housing assembly 30. The example vent plugs 42 are threaded to mate with the threaded vent openings 40. Threading one of the vent plugs 42 into one of the vent openings 40 substantially prevents fluid such as air from flowing through the plugged vent opening 40.

FIG. 1 illustrates that the vent openings 40 of the example housing assembly 30 are arranged or formed at a first vent location 50, a second vent location 52, a third vent location 54, a fourth vent location 56, and a fifth vent location 58; these vent locations 50-58 are spaced from each other along the drive axis A. Typically, a plurality of the vent openings 40 are angularly spaced around the circumference of the housing assembly 30 at each of the vent locations 50-58.

Accordingly, the vent openings 40 and plugs 42 can be used as will be described in further detail below to control the flow of fluids, and in particular air, into and out of the main chamber 38 defined by the housing assembly 30. By controlling the flow of fluids into and out of the main chamber 38 at different axially spaced vent locations, the pile driving system 20 allows the operator to vary a pre-strike load applied on the anvil assembly 34, helmet assembly 36, and pile 22.

During operation, the pile driving system 20 moves through an operating cycle as will now be described with reference to FIGS. 5A-5H. When operating, the drive axis A of the pile driving system 20 is typically substantially vertical, but may be canted or angled slightly with respect to vertical depending upon the nature and use of the particular pile being driven. In the following discussion, the drive axis A will be considered substantially upright or vertical, and any directional terms should be read in the context of a substantially vertical or upright drive axis A as depicted and described.

In a pre-drop mode, the hammer assembly 32 is in a raised position relative to the housing assembly 30. The anvil assembly 34 is in a pre-strike position relative to the housing assembly 30 when the pile driving system 20 is in the pre-drop mode.

Figure 5B:
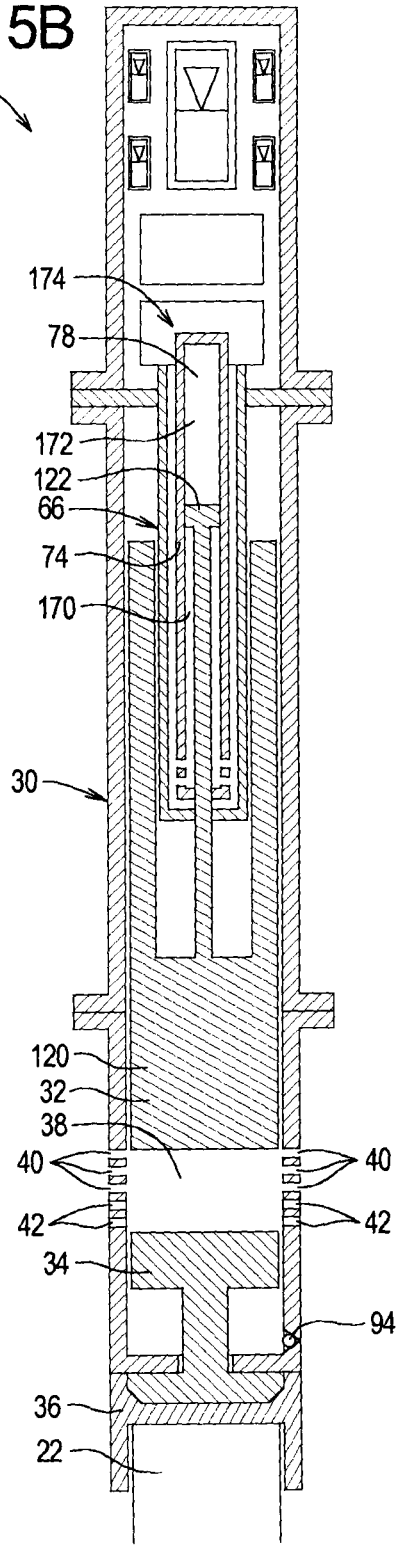

When the pile driving system 20 is in a free-fall mode, the hammer assembly 32 falls from the raised position (FIG. 5A) to a first intermediate position (FIG. 5B). While the hammer assembly 32 falls from the raised position to the first intermediate position, air below the hammer assembly 32 flows freely out of one or more of the unplugged vent openings 40 formed in the housing assembly 30. As described above, air will not flow out of any vent opening 40 plugged by one of the vent plugs 42.

When the hammer assembly 32 is above the first intermediate position, air is able to flow out of all unplugged vent openings 40. The cumulative cross-sectional area of the uncovered and unplugged openings 40 in the pre-compression mode is at a maximum when the system 20 is in the free-fall mode. The operator will typically leave enough vent openings 40 unplugged such that the hammer assembly 32 free-falls. The term "free-fall" is thus used herein to refer to a situation in which resistance to downward movement of the hammer assembly 32 by fluids such as air below the hammer assembly 32 is negligible. Therefore, in the free-fall mode compression of air within the main chamber 38 below the hammer assembly 32 is negligible.

Figure 5C:
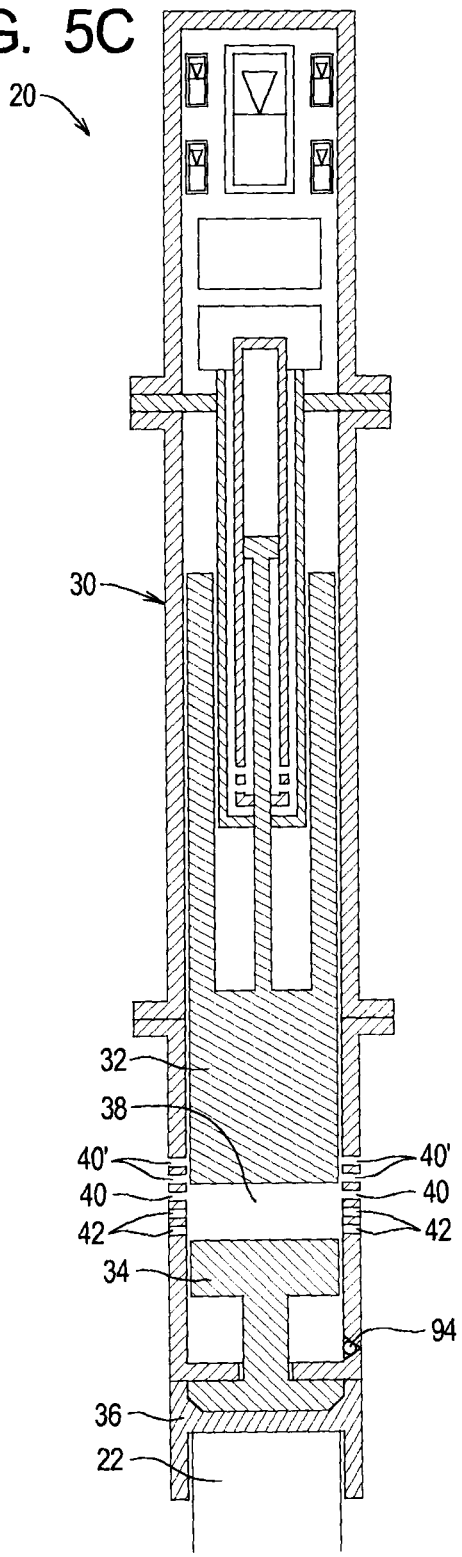

Referring now to FIG. 5C, the pile driving system 20 is depicted in a pre-compression mode in which the pressure of air within the main chamber 38 below the hammer assembly 32 begins to increase. In the pre-compression mode, the hammer assembly 32 blocks passage of air through one or more of the unplugged vent openings 40. However, at least some of the vent openings 40 are still uncovered and unplugged, so air within the main chamber 38 below the hammer assembly 32 is able to flow out of the main chamber 38 through any such uncovered and unplugged vent ports, but such flow is restricted in comparison with the free-fall mode. Unplugged but covered vent openings are identified using the reference character 40' in the drawings.

The cumulative cross-sectional area of the uncovered and unplugged vent ports in the pre-compression mode is less than that of the unplugged ports in the free-fall mode. In the pre-compression mode, fluids such as air within the hammer assembly 32 begin to compress because the flow through the vent openings 40 is restricted. Accordingly, in the pre-compression mode, pressure within the main chamber 38 below the hammer assembly 32 increases, causing the anvil assembly 34 and the helmet assembly 36 to move towards the pile 22.

Figure 5D:
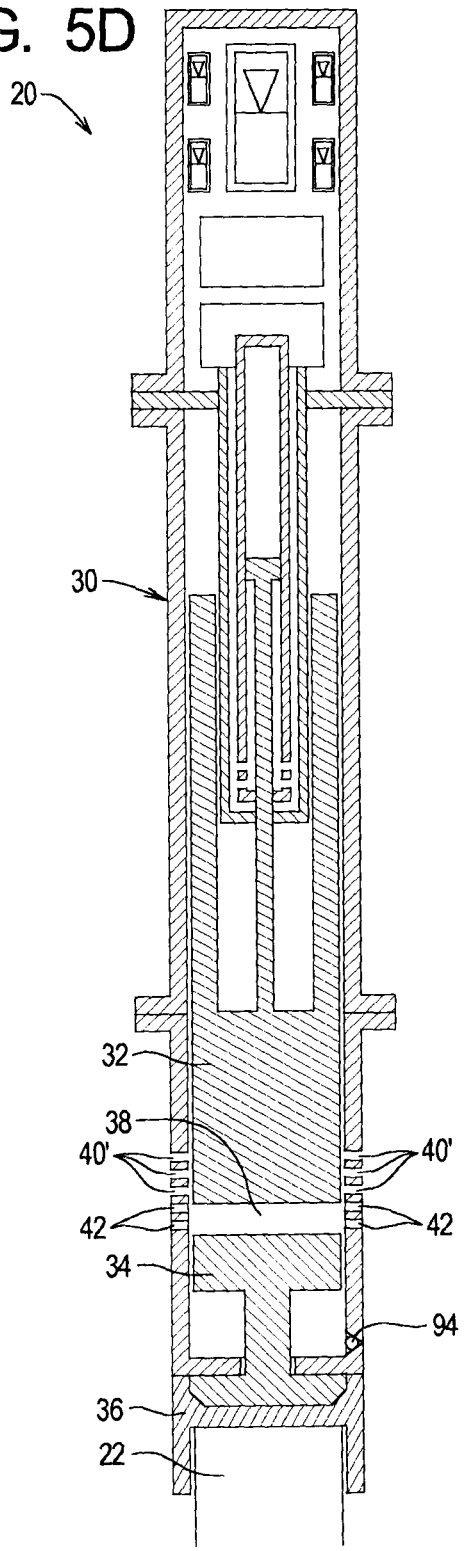

As the hammer assembly 32 moves in the pre-compression mode between the positions depicted in FIGS. 5B and 5D, the cumulative cross-sectional area of the vent openings 40 through which fluids may pass gradually decreases.

As the hammer assembly 32 continues to fall, the pile driving system 20 enters a compression mode as shown in FIG. 5D. In the compression mode, the hammer assembly 32 passes and thus covers all unplugged vent openings 40, preventing flow of air out of the main chamber 38 through any of the vent openings 40. Accordingly, in the compression mode, the fluids within the main chamber 38 below the hammer assembly 32 can only compress, significantly increasing the pressure within this portion of the main chamber 38. Increased pressure within the main chamber 38 below the hammer assembly 32 causes the anvil assembly 34 and the helmet assembly 36 to move towards and tighten against the pile 22.

Figure 5E:
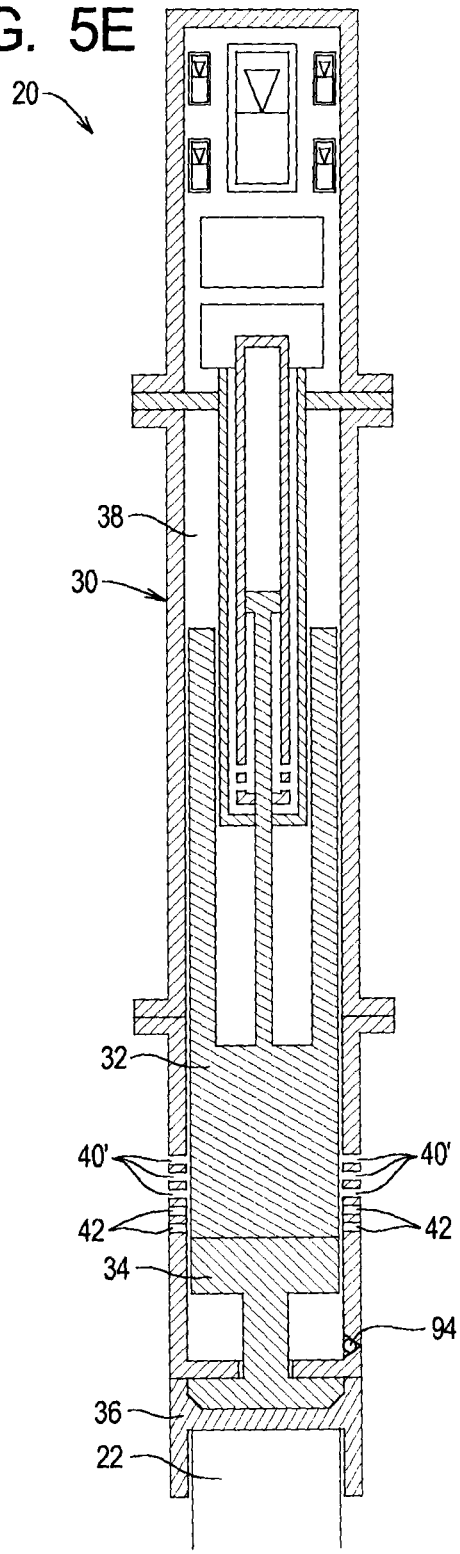

The hammer assembly 32 continues to fall, eventually completely compressing the air within the main chamber 38 below the hammer assembly 32 and striking the anvil assembly 34 as shown in FIG. 5E. The pile driving system 20 enters a drive mode when the hammer assembly 32 comes into contact with the anvil assembly 34. By the time the hammer assembly 32 strikes the anvil assembly 34, the compressed fluids within the main chamber 38 have fully tightened the anvil assembly 34 against the helmet assembly 36 and the helmet assembly 36 against the pile 22.

Figure 5F:
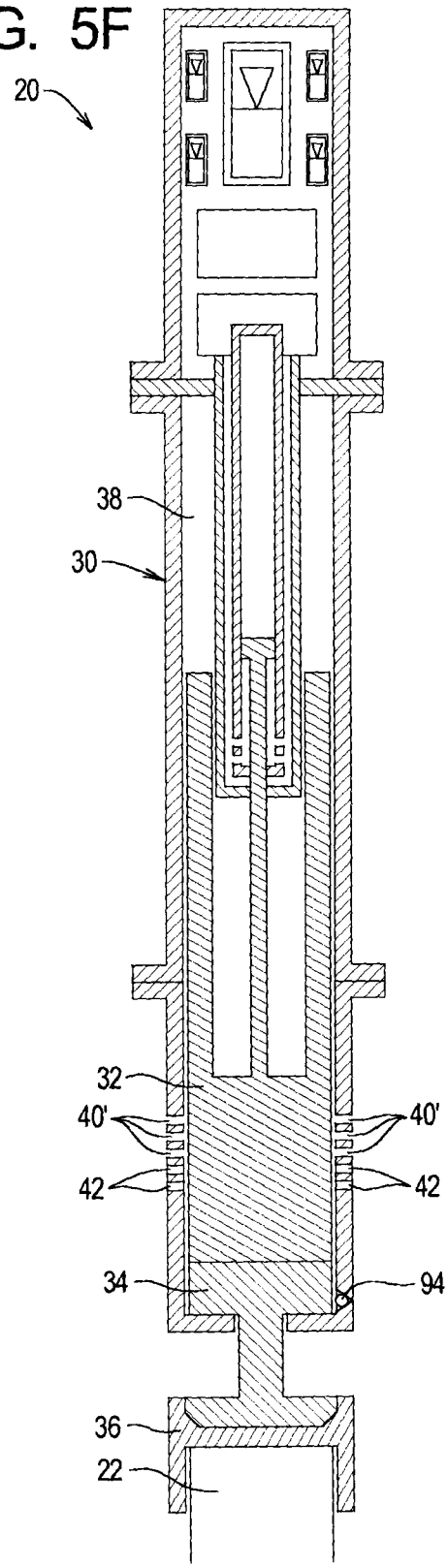

Continued downward movement of the hammer assembly 32 in the drive mode is transferred through the anvil assembly 34 and the helmet assembly 36 to the pile 22, displacing the pile 22 as shown by a comparison of FIGS. 5E and 5F. The anvil assembly 34 is in an upper position relative to the housing assembly 32 at the beginning of the drive mode (FIG. 5E) and in a lower position relative to the housing assembly 32 at the end of the drive mode (FIG. 5F) at the beginning of the drive mode.

Figure 5G:
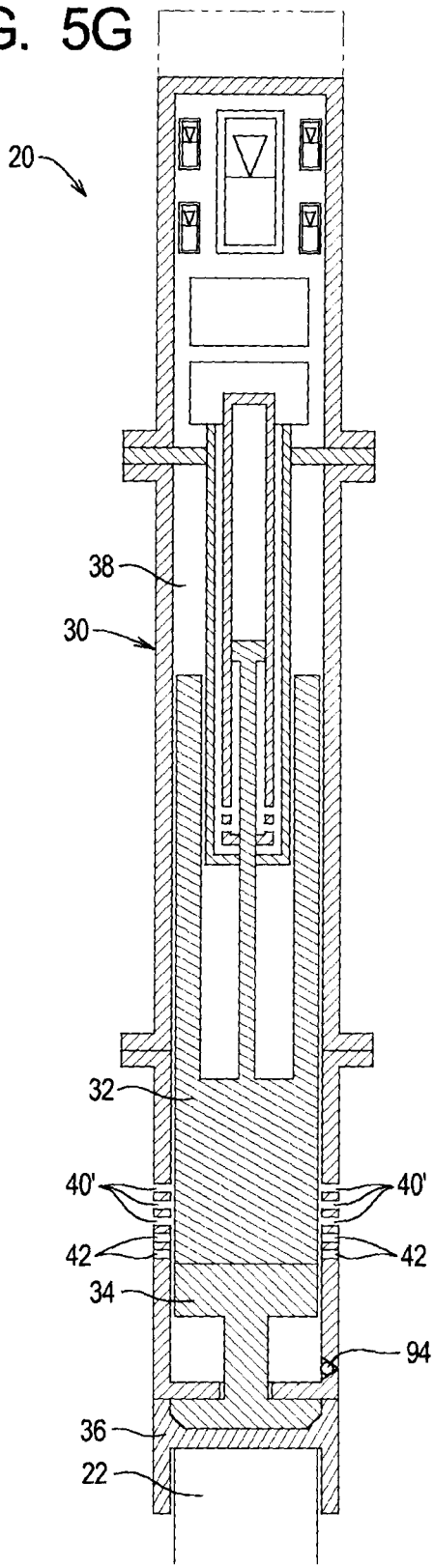
Figure 5H:
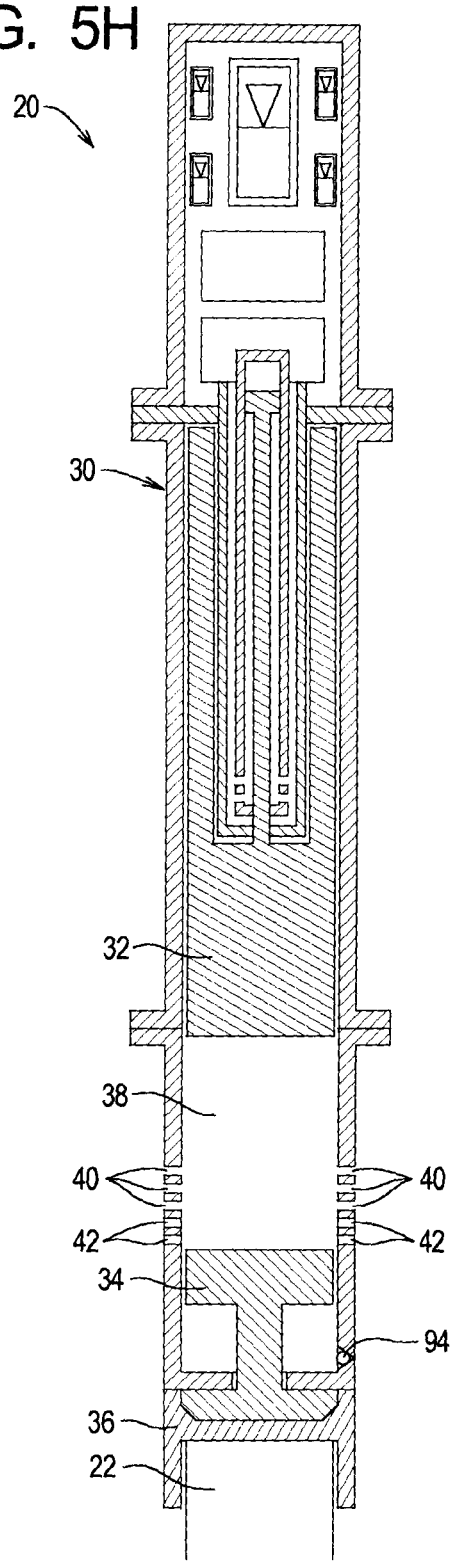

As shown in FIGS. 5G and 5H, the pile driving system 20 next enters a return mode in which the hammer assembly 32 is returned into the pre-drop mode relative to the housing assembly 30. As the hammer assembly 32 raises, the anvil member 34 moves from the lower position to the upper position as shown in FIG. 5G. In FIG. 5H, the pile driving system 20 is depicted in the same pre-drop mode depicted in FIG. 5A, except that the pile 22 on which the pile driving system 20 rests has been displaced downwardly.

The use of a compression mode aligns the anvil assembly 34 and helmet assembly 36 with the pile 22 and also removes almost all play or slop between these various components before the hammer assembly 32 strikes the anvil assembly 34. When the hammer assembly 32 eventually strikes the anvil assembly 34, noise is reduced. Further, damage to the helmet assembly 36 and pile 22 is also reduced because the driving forces are applied to the helmet assembly 36 and pile 22 in a manner that reduces resonant vibrations, and the resulting stresses within the materials forming the helmet assembly 36 and the pile 22.

The use of a pre-compression mode allows the operator to tune or adjust the pile driving system 20 for a particular pile type and soil conditions. And the use of provision of vent openings 40 located at different vent locations 50-58 and vent plugs 42 provides the operator with significantly more flexibility in the tuning or adjusting of the pile driving system 20. The operator may thus develop a desired compression profile for a particular set of operating conditions by selecting the number and location of vent openings 40 that will be plugged or will remain unplugged. The desired compression profile can be created by an operator empirically onsite or can be calculated in advance.

Referring now to FIGS. 1-5, 6A, and 6B, the details of construction and operation of the example pile driving system 20 will be explained in further detail. As shown in FIG. 1, the housing assembly 30 comprises a first section 60, a second section 62, a third section 64, a cylinder assembly 66, and a support plate 68. The first and second sections 60 and 62 are joined together to define the main chamber 38. The third section 64 is joined to the second section 62 by the support plate 68 to define a hydraulics chamber 70. The support plate 68 supports the cylinder assembly 66 partly within the main chamber 38 and partly within the hydraulics chamber 70.

The cylinder assembly 66 comprises an outer cylinder 72 and an inner cylinder 74 coaxially supported to define an outer chamber 76 and a piston chamber 78. The outer cylinder 72 defines a shaft port 80 and an inlet port 82. The inner cylinder 74 defines a shaft port 84, an inlet port 86, and an exhaust port 88.

A seal member 90 is arranged at the shaft port 80 defined by the outer cylinder 72. The first housing section 60 defines the vent openings 40 and an anvil port 92.

One or more check valves 94 are arranged in the housing assembly 30 at the bottom of the main chamber 38. The check valves 94 prevent air from exiting the main chamber 38 when the pile driving system 20 is in the compression mode but to allow air to be drawn into the main chamber 38 when the pile driving system 20 is in the return mode.

Figure 2:
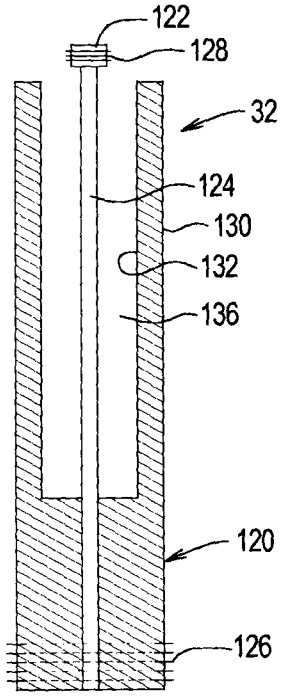
FIG. 2 is a somewhat schematic section view of an example hammer assembly of a pile housing assembly of the present invention.

Turning now to FIG. 2, the example hammer assembly 32 will now be described in further detail. The example hammer assembly 32 comprises a hammer member 120, a piston member 122, a piston shaft 124, a first set of ring seals 126, and a piston seal 128. The hammer member 120 defines an outer surface 130 and an inner surface 132. The inner surface 132 defines a cylinder cavity 136. The first set of ring seals 126 is arranged on the hammer member 120, while the piston seal 128 is arranged on the piston member 122.

Figure 3:
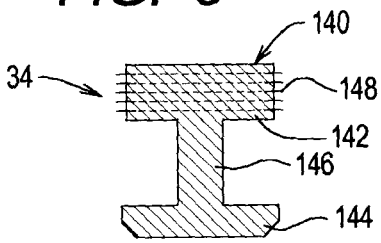
FIG. 3 is a front elevation view of an example anvil assembly of a pile driving system of the present invention.
Figure 4:
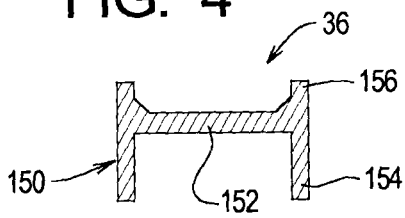
FIG. 4 is a section view of an example helmet of pile driving system of the present invention.

As shown in FIG. 3, the example anvil assembly 34 comprises an anvil member 140 defining an internal portion 142, an external portion 144, and a bridge portion 146. A second set of ring seals 148 is arranged on the internal portion 142.

FIG. 4 illustrates that the example helmet assembly 36 comprises a helmet member 150 having a plate portion 152, a skirt portion 154, and a flange portion 156. The skirt portion 154 is configured to receive the upper end of the pile 22, while the flange portion 156 is adapted to receive the external portion 144 of the anvil member 140.

FIG. 1 further illustrates that the hydraulic chamber 70 defined by the third section 64 of the housing assembly 30 contains components of a hydraulic drive system as will be described in further detail below.

As indicated by FIGS. 5A-5H, the housing assembly 30 supports the hammer assembly 32 such that the hammer member 120 is within the main chamber 38 and the piston member 122 is within the piston chamber 78 defined by the inner cylinder 74. As perhaps best shown in FIG. 5B, the piston member 122 divides the piston chamber 78 into a drive portion 170 and an exhaust portion 172.

The piston member 122 and cylinder assembly 66 thus form a hydraulic actuator 174 capable of displacing the hammer assembly 32. To raise the hammer assembly 32, fluid is forced into the annular outer chamber 76 through the inlet port 82 defined by the outer cylinder 72. Fluid flowing through the outer chamber 76 flows through the inlet port 86 defined by the inner cylinder 74 and into the drive portion 170 of the piston chamber 78. Pressurized fluid within the drive portion 170 of the piston chamber 78 acts on the piston member 122 to displace the hammer assembly 32 upward as shown by a comparison of FIGS. 5G and 5H.

The example hydraulic actuator 174 is a single acting device that employs gravity to displace the hammer assembly 32 in one direction (downward) and hydraulic fluid to displace the hammer assembly 32 in the opposite direction (upward). To allow gravity to displace the hammer assembly 32, the pressure on the hydraulic fluid within the drive portion 170 of the piston chamber 78 is removed. To facilitate raising of the hammer assembly 32, little or no pressure should be exerted on the top of the hammer member 120 within the main chamber 38 or the top of the piston member 122 within the exhaust portion 172 of the piston chamber 78.

Referring a moment back to FIG. 1, depicted therein is a trip assembly 180 mounted on the housing assembly 30. The trip assembly 180 comprises a trip mechanism 182, a trip valve 184, and a displacement system 186. The trip mechanism 182 comprises a trip member 188 capable of engaging the hammer assembly 32 as the hammer assembly 32 moves within the main chamber 38.

The displacement system 186 comprises a trip sled 190 that supports the trip mechanism 182, a gear member 192, and a sled motor 194. Operation of the sled motor 194 causes of axial rotation of the gear member 192. The gear member 192 in turn engages the trip sled 190 such that the trip sled can be moved along the drive axis A by operation of the sled motor 194.

The displacement system 186 thus allows the location of the trip mechanism 182 to a desired trip position along the drive axis A. As will be described in further detail below, the trip position determines the height of the hammer assembly 32 when the pile driving system is in the pre-drop mode (i.e., the uppermost position of the hammer assembly 32).

Figure 6A:
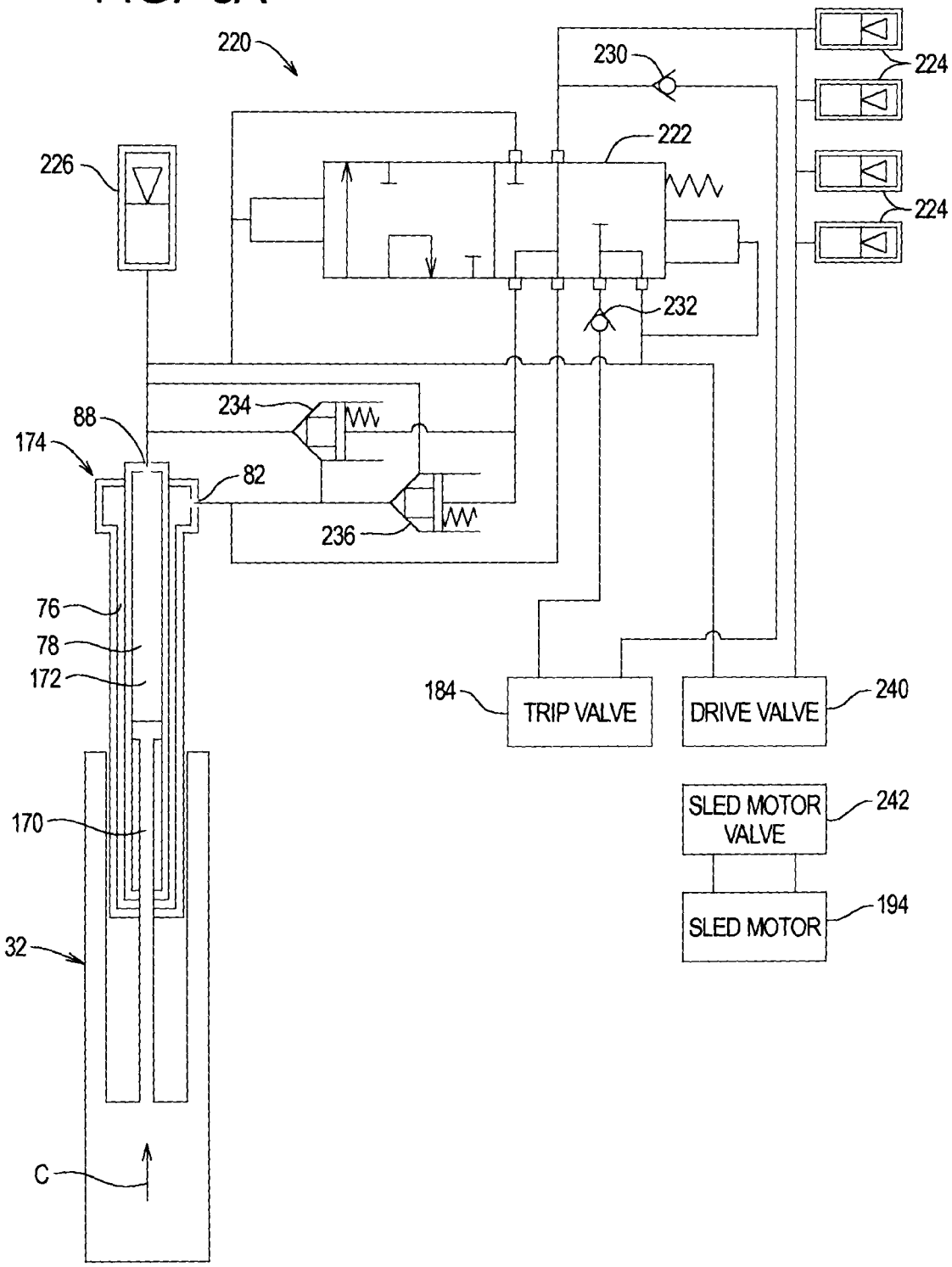
FIGS. 6A and 6B are schematic drawings illustrating first and second operating modes of a hydraulic system that may be used as part of a pile driving system of the present invention.
Figure 6B:
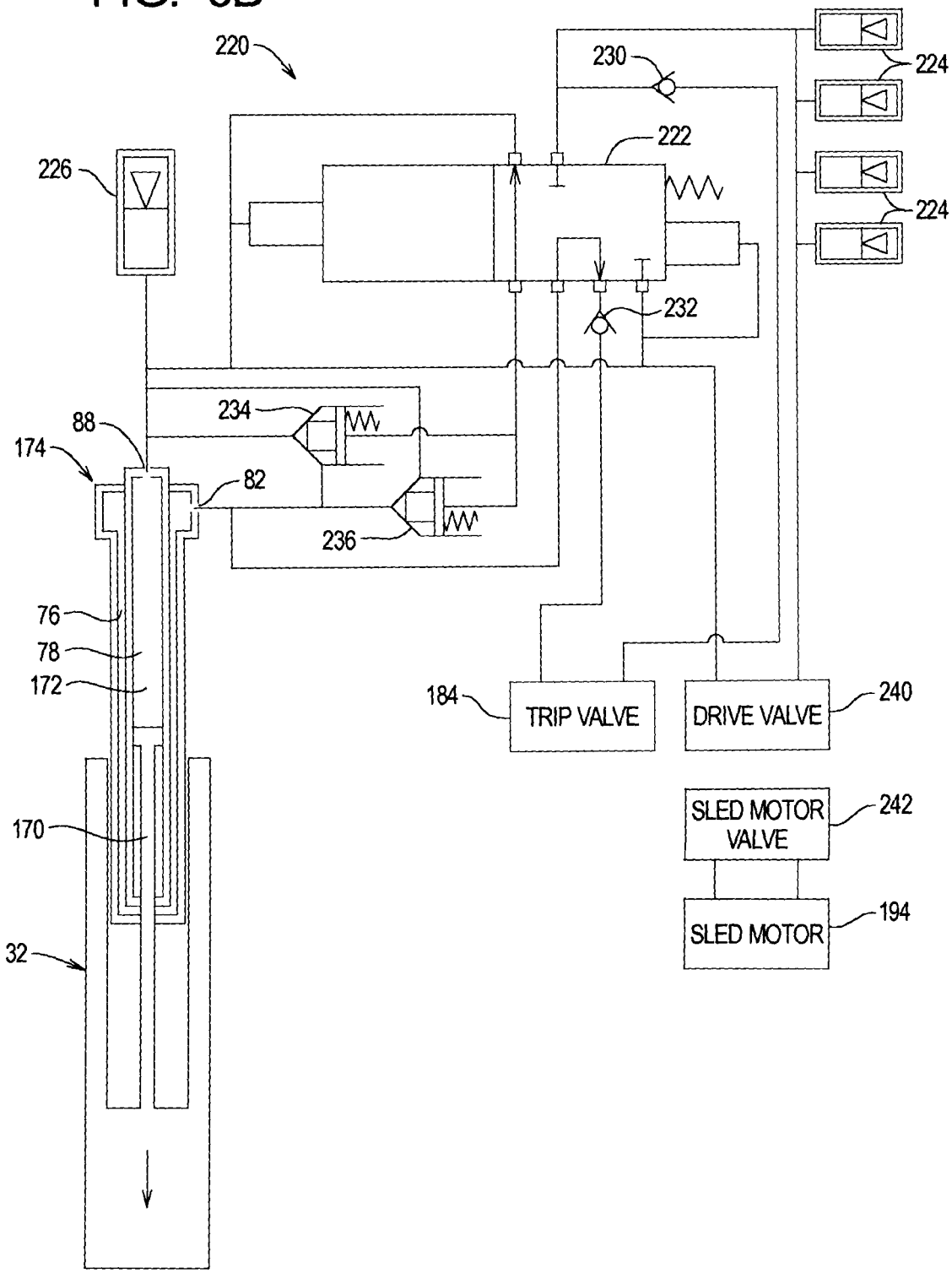

Referring now to FIGS. 6A and 6B of the drawing, depicted therein is an example hydraulic system 220 that may be used by the example pile driving system 20. The hydraulic system 220 comprises a main control valve 222, power accumulators 224, and an exhaust accumulator 226. The trip valve 184 and sled motor 194 are also depicted in FIGS. 6A and 6B in the context of the hydraulic system. Check valves 230 and 232 and cartridge valves 234 and 236 are arranged as shown to provide the functionality described below.

A conventional power pack represented by a drive valve 240 forms a source of pressurized fluid that is supplied to the system 220. The power pack further provides a source of pressurized fluid through a sled motor valve 242 for activating the sled motor 194; the sled motor 194 is activated independently from the rest of the hydraulic system 220. The sled motor valve 242 may be implemented using the clamp valve of a conventional power pack.

The main control valve 222 operates in a first configuration (FIG. 6A) and a second configuration (FIG. 6B). In the first configuration, pressurized fluid is continuously supplied to the inlet port 82 of the outer chamber 76. This pressurized fluid flows into the drive portion 170 of the piston chamber 78 as described above to raise the hammer assembly 32 as shown by arrow C in FIG. 6A. When the hammer assembly 32 engages the trip member 188, the trip valve 184 is actuated to remove or disable a raise signal applied to the main control valve 222.

When this raise signal is removed, the main control valve 222 changes to the second configuration as shown in FIG. 6B. In this second configuration, the main control valve 222 disconnects the drive portion 170 of the piston chamber 78 from the source of pressurized fluid. Gravity acting on the hammer assembly 32 displaces the hammer assembly 32 down, forcing fluid out of the drive portion 170 of the piston chamber 78.

The main control valve 222 can be placed back into the first configuration manually or automatically based on a sensor, a time delay, or pressure level on the fluid within the drive portion 170 of the piston chamber indicating that the hammer assembly 32 is in its lowest position relative to the housing assembly 30.

Given the foregoing, the Applicants have concluded that the operation of conventional drop hammer systems can be improved by establishing a pre-load state prior to impact that is generally similar to the compression state of a diesel hammer. The Applicants believe that the preload state will stretch out the compression force in the stress wave and thereby substantially reduce the possibility of tension cracking and damage in concrete piles.

What is claimed is:

1. A drop hammer for driving a pile comprising:

a housing assembly defining a drive axis, a main chamber, and a plurality of vent openings that allow fluid to flow into and out of the main chamber, where at least one vent opening is arranged at a first vent location along the drive axis, and at least one vent opening is arranged at a second vent location along the drive axis, where the second vent location is spaced along the drive axis from the first vent location;

a hammer supported within the main chamber for movement relative to the housing assembly between an upper position and a lower position, where the first and second vent locations are located between the upper and lower positions;

a helmet member supported by the housing assembly for movement relative to the housing assembly between a first position and a second position;

a lifting system capable of being operatively connected to and detached from the hammer, where the lifting system positively acts on the hammer to displace the hammer from the lower position to the upper position during each cycle, and is released from the hammer to allow gravity to displace the hammer from the upper position to the lower position during each cycle; and at least one plug; whereby when the hammer drops and is above the first vent location, ambient air flows from the main chamber through the vent openings formed at the first and second vent locations;

when the hammer drops and is below the first vent location and above the second vent location, ambient air flows from the main chamber through the vent openings formed at the second vent location;

when the hammer drops and is below the second vent location, air within the main chamber is compressed to preload the helmet member prior to contact between the hammer and helmet member; and the pile driving system operates in a first mode in which the vent openings at the first and second locations are open, and a second mode in which the at least one plug is configured to prevent fluid flow through the at least one vent opening at the second location.

2. A drop hammer as recited in claim 1, further comprising a plurality of plugs for plugging a plurality of the vent openings.

3. A drop hammer as recited in claim 1, in which the lifting system comprises a hydraulic actuator at least partly arranged within the main chamber.

4. A drop hammer as recited in claim 3, in which the hammer defines a cylinder cavity, where the hydraulic actuator is disposed at least partly within the cylinder cavity when the hammer is in the upper position.

5. A drop hammer as recited in claim 1, in which the housing assembly further defines a hydraulic chamber, where hydraulic components are arranged within the hydraulic chamber.

6. A drop hammer as recited in claim 1, further comprising an anvil, where the compressed air within the main chamber preloads the helmet prior to contact between the hammer and the anvil.

7. A drop hammer method of driving a pile using a lifting system to that is attached to and detached from a hammer comprising the steps of:

providing a housing assembly defining a drive axis and a main chamber;

forming at least one vent opening in the housing at a first vent location along the drive axis, and forming at least one vent opening at a second vent location along the drive axis, where the second vent location is spaced along the drive axis from the first vent location;

altering a compression profile with which the pile is driven by selectively plugging the at least one vent opening at the second vent location;

supporting the hammer at least partly within the main chamber for movement relative to the housing assembly between an upper position and a lower position, where the first and second vent locations are located between the upper and lower positions;

supporting a helmet member for movement relative to the housing assembly between a first position and a second position; and operating the lifting system to positively displace the hammer to lift the hammer from the lower position to the upper position during each cycle;

operating the lifting system to release the hammer such that the gravity causes the hammer to drop from the upper position to the lower position during each cycle;

allowing ambient air to flow from the main chamber through the vent openings formed at the first and second vent locations when the hammer is moving down and is above the first vent location;

allowing ambient air to flow from the main chamber through the vent openings formed at the second vent location when the hammer drops down and below the first vent location and above the second vent location; and compressing air within the main chamber below the hammer to preload the helmet member as the hammer drops and prior to contact between the hammer and helmet member when the hammer is below the second vent location.

8. A drop hammer method as recited in claim 7, further comprising the step of plugging a plurality of the vent openings.

9. A drop hammer method as recited in claim 7, in which the step of displacing the hammer from the lower position to the upper position comprises the step of arranging a hydraulic actuator at least partly within the main chamber.

10. A drop hammer method as recited in claim 9, further comprising the steps of:

forming a cylinder cavity in the hammer; and disposing the hydraulic actuator at least partly within the cylinder cavity when the hammer is in the upper position.

11. A drop hammer method as recited in claim 7, further comprising the step of arranging hydraulic components within a hydraulic chamber defined by the housing assembly.

12. A drop hammer method as recited in claim 7, further comprising the step of arranging an anvil such that compressed air within the main chamber preloads the helmet prior to contact between the hammer and the anvil.

13. A drop hammer for driving a pile comprising:

a housing assembly defining a drive axis, a main chamber, and a plurality of vent openings that allow fluid to flow into and out of the main chamber, where at least one vent opening is arranged at a first vent location along the drive axis, and at least one vent opening is arranged at a second vent location along the drive axis, where the second vent location is spaced along the drive axis from the first vent location;

a plurality of plugs, where at least one of the plugs is engaged with at least one of the vent openings to obtain first and second compression profiles;

a hammer supported within the main chamber for movement relative to the housing assembly between an upper position and a lower position, where the first and second vent locations are located between the upper and lower positions;

a helmet member supported by the housing assembly for movement relative to the housing assembly between a first position and a second position; and a lifting system system capable of being operatively connected to and detached from the hammer, where the lifting system positively acts on the hammer to displace the hammer from the lower position to the upper position during each cycle, and is released from the hammer to allow gravity to displace the hammer from the upper position to the lower position during each cycle; whereby when the hammer drops, ambient air flows from the main chamber through the vent openings formed at the first and second vent locations according to the first compression profile;

when the hammer drops, ambient air flows from the main chamber through the vent openings formed at the first vent location according to the second compression profile; and air within the main chamber is compressed to preload the helmet member prior to contact between the hammer and helmet member according to one of the first and second compression profiles.

14. A drop hammer as recited in claim 13, in which the lifting system comprises a hydraulic actuator at least partly arranged within the main chamber.

15. A drop hammer as recited in claim 14, in which the hammer defines a cylinder cavity, where the hydraulic actuator is disposed at least partly within the cylinder cavity when the hammer is in the upper position.

16. A drop hammer as recited in claim 13, in which the housing assembly further defines a hydraulic chamber, where hydraulic components are arranged within the hydraulic chamber.

17. A drop hammer as recited in claim 13, further comprising an anvil, where the compressed air within the main chamber preloads the helmet prior to contact between the hammer and the anvil.

* * * * *